United States Patent [19]

Szazdi, Jr. et al.

[11] Patent Number: 5,048,763

[45] Date of Patent: Sep. 17, 1991

[54] MULTI-PASS ROLL CRUSHER

[75] Inventors: John S. Szazdi, Jr., Bethlehem; Thomas R. Lawall, Emmaus, both of Pa.

[73] Assignee: Fuller Company, Bethlehem, Pa.

[21] Appl. No.: 483,591

[22] Filed: Feb. 21, 1990

[51] Int. Cl.[5] ..... B02C 4/02

[52] U.S. Cl. ..... 241/24; 241/29; 241/97; 241/152 A; 241/224

[58] Field of Search ..... 247/224, 30, 226, 97, 247/80, 3, 29, 24, 101.4, 152 A

[56] References Cited

U.S. PATENT DOCUMENTS

| | | | |
|---|---|---|---|
| 4,357,287 | 11/1982 | Schonert | 241/29 X |
| 4,690,335 | 9/1987 | Allers et al. | 241/152 A X |
| 4,728,044 | 3/1988 | Duill et al. | 241/152 A X |

FOREIGN PATENT DOCUMENTS

| | | | |
|---|---|---|---|
| 3742552 | 7/1989 | Fed. Rep. of Germany | 241/224 |
| 3806398 | 9/1989 | Fed. Rep. of Germany | 241/224 |

*Primary Examiner*—Mark Rosenbaum

*Attorney, Agent, or Firm*—Daniel DeJoseph

[57] ABSTRACT

Disclosed is an apparatus and a method for the comminution of brittle material in a roll crusher. The method comprises the steps of introducing fresh material feed into a roll crusher which is divided into two distinct feed inlet zones which are at least one initial feed inlet zone for said fresh feed material and at least one secondary feed inlet zone for feed which has been stressed at least once by said roll crusher. Each initial feed inlet zone and each secondary feed inlet zone directs feed into, respectively, a corresponding initial feed crushing zone and secondary feed crushing zone. In the invention, fresh feed material is introduced into the roll crusher only in the initial feed inlet zone(s) whereby it is stressed at pressures sufficient high to cause the formation of at least some agglomerates. The product thus formed is recirculated, without causing any substantial disintegration of the agglomerates, into the roll crusher through the secondary feed inlet zone whereby it is further stressed at pressures sufficient to cause the formation of at least some agglomerates.

16 Claims, 1 Drawing Sheet

MULTI-PASS ROLL CRUSHER

This invention relates to a method for the comminution and particularly for the fine comminution of solid material with a roll crusher.

BACKGROUND OF THE INVENTION

Comminution is the transformation of particles of a hard material into a greater number of smaller size particles and can include any of the processes of crushing, grinding or milling.

A roll crusher is an apparatus which may be utilized in the cement and in other mineral processing industries for carrying out the comminution of brittle material. Roll crushers consist of one or two rolls which function by crushing particles of brittle material between the rotating rolls or between one roll and a stationary breaker plate.

In pressure comminution of brittle grinding stock in the roller gap of a roll crusher, the grinding stock is crushed or comminuted by means of compressive stress. The feed for the roll crusher may be uniformly distributed over the width of the roll(s). Alternatively, the feed may be distributed to the roll by a method known as "choke feeding", wherein the feed is fed to the roll in sufficient volume to produce a packed or compact mass of material as it passes between the rolls so that the particles of the feed mutually crush one another in the roller gap to produce an agglomerated product bed. The product which is comminuted by a roll crusher is generally conveyed, after a deagglomeration step, if necessary, to a classifier and, typically, product exceeding a certain size is recirculated back through the roll crusher where it is intermingled with fresh feed which is being delivered into the roll crusher. Obviously, there is a physical limitation as to how much of the product can be recirculated back through the roll crusher with fresh feed.

When a high degree of comminution or high fineness of the grinding stock is to be achieved, multi-stage grinding methods such as pre-comminution, mean comminution and fine comminution have been employed. The multi-stage grinding methods which can, for example, consist of comminution machines such as roller mills, roll crushers and/or ball mills connected in series, however, produce a high overall specific energy consumption as well as high overall capital costs. Ball mills are distinguished by high degree of comminution and can grind chunks of cement clinker to cement fineness but the specific energy required by ball mills, however, is high.

U.S. Pat. No. 4,357,287, Schönert, teaches a method of carrying out the fine and very fine comminution of brittle material wherein a bulk of brittle material is stressed once between two practically non-yielding hard surfaces, such as the rolls of a roll crusher, with a compression of at least 500 kg/cm$^2$ to result in energy sufficiently high to cause comminution and to also cause a distinct agglomeration or briquetting of the particles, and where the resulting agglomerates or briquettes are disintegrated by further mechanical stressing in a separate device. This referenced patent teaches and claims that by carrying out such stressing in a single pass the energy needed to comminute said particles will be substantially reduced. This reference does not teach or suggest that multiple stressing as characterized by more than one pass of the material through the roll crusher would result in energy savings.

It is now been surprisingly discovered that if the material to be stressed is subjected to at least two separate passes through the same roll crusher wherein the recirculated material is not co-mingled with fresh feed, at pressures which for both stresses is sufficiently high to cause the formation of at least some agglomerates on both passes, there is realized substantial energy savings over the process as taught in U.S. Pat. No. 4,357,287. This energy savings is completely unexpected in view of the teaching of said patent. It has also been discovered that a continuous process for such multiple stressing can be carried out on a novel roll crusher which has distinct initial and secondary inlet, crushing and outlet zones, whereby any material that is present in the initial inlet or crushing zone is routed so as to minimize intermingling with material that is present in the secondary inlet or crushing zone.

SUMMARY OF THE INVENTION

The present invention provides a comminution method and apparatus by means of which a brittle product can be comminuted or crushed to a high degree of fineness and is distinguished by a relatively low total energy consumption.

The present invention utilizes a roll crusher which has at least two distinct feed inlet zones: at least one initial feed inlet zone which introduces feed into the roll crusher by passing it to an initial crushing zone which is directly below the initial feed inlet zone; and at least one secondary feed inlet zone which likewise leads into a secondary crushing zone. Partitions provided for the roll crusher act to minimize feed migration between the first inlet zone and the second inlet zone and between the initial crushing zone and the secondary crushing zone. Likewise, suitable methods are employed, such as through the use of partitions, so that the product exiting the rollers from the initial crushing zone will not comingle with the product exiting the rollers from the secondary crushing zone, to thereby insure that all final product will have had at least two passes through the rollers. The roll crusher is designed to apply pressures in both the initial and secondary feed crushing zones that are sufficiently high to cause the formation of agglomerates in both zones. In the method of the present invention, fresh feed is initially introduced into the roll crusher through the initial feed inlet zone(s), whereupon it passes into the initial feed crushing zone(s) where it is stressed at pressures sufficiently high to cause the formation of at least some agglomerates in said initial feed crushing zone. All the material is then collected from said initial feed crushing zone(s) and recirculated by being introduced back through the roll crusher via the secondary inlet zone through which it passes into the secondary crushing zone. After finally passing through the secondary crushing zone, the material is collected and the agglomerates that have formed as a result of the first and second passes are disintegrated. The disintegration or deagglomeration of the agglomerates can be carried out by any method that is well known in the art. For example, standard ball mills or impact mills can be utilized for such purposes. It is anticipated that this process will be run continuously, so that while the material from the initial feed crushing zone(s) is recirculated to the secondary feed inlet zone(s) fresh feed will be simultaneously introduced to the initial feed inlet zone(s). It is a crucial feature of the present invention, however, that fresh feed always enter the roll crusher via the initial feed inlet zone(s) and any final product only come from the secondary feed crushing zone(s).

The method of the present invention is adaptable for the comminution of brittle raw materials, such as, for example, naturally occurring rocks or minerals which are suitable for the manufacture of cement or cement clinker, which is the fused product of a kiln and which is ground to make cement and which is produced from said raw materials. In particular, the process of the present invention is suitable for cement production, cement clinker, ores and coals, as well as lime, bauxite, dolomite, alkaline earth carbonates, and similar minerals or mixtures thereof.

DETAILED DESCRIPTION OF THE INVENTION

In the preferred process and apparatus of the present invention, the roll crusher has at least 3 defined feed inlet and crushing zones, the location of which are defined by their position across the length of the roll face: at least one, and preferably only one, secondary feed inlet zone which is located approximately in the middle of the roll face and does not extend to either edge of the roll face and two separate initial feed inlet zones that begin on each edge of the roll face and extend inwardly across the length of the roll face. In the preferred practice of this invention, incoming fresh feed is directed into each of two initial feed inlet zones that are separately located in proximity to each of the edges, i.e. ends, of the roll, after which the feed passes into initial feed crushing zones that are in communication with each of said initial feed inlet zones. The initial feed crushing zones take up approximately the same area, as measured across the length of the roll, as the feed inlet zones to which they are in communication. The freshly crushed material is then collected as it exits the rolls, with care being taken not to disintegrate any of the agglomerates formed in said initial pass through the rolls, and is then redirected, such as by recirculation techniques, down the middle zone of the roll crusher where it is crushed to a finer consistency than it was during the first pass. When the roll crusher apparatus of the present invention is operating during the typical production run, it will simultaneously be conducting 2 types of grinding operations: a comparatively coarse grinding operation in the initial crushing zone(s) and a finer grinding operation conducted in the secondary crushing zone(s).

In the practice of the present invention, incoming fresh feed material is crushed at pressures sufficiently high to cause at least some agglomerate to be formed. The freshly crushed material from each initial feed crushing zone is preferably combined, and redirected, using standard recirculation equipment well known to those skilled in the art, down a secondary feed inlet zone that is located in the middle of the roll crusher where it is crushed at pressures sufficient to cause at least some agglomerate to form. It is an important processing feature of this invention that a deagglomeration step is not done to the material until after it is passed through the secondary crushing zone of the roll crusher.

Another important feature of the present invention is that the co-mingling of the intermediate product resulting from the initial pass through the roll crusher with the product exiting the roll crusher from the secondary crushing zone is minimized or prevented entirely.

After the product's final exit from the roll crusher, the agglomerates formed during the multiple passes are subject to disintegration and the resulting particles can then be classified, if desired.

BRIEF DESCRIPTION OF THE DRAWINGS

The invention and further advantages thereof are explained in more detail with reference to the embodiment set forth diagrammatically in the drawings.

Figure 2:
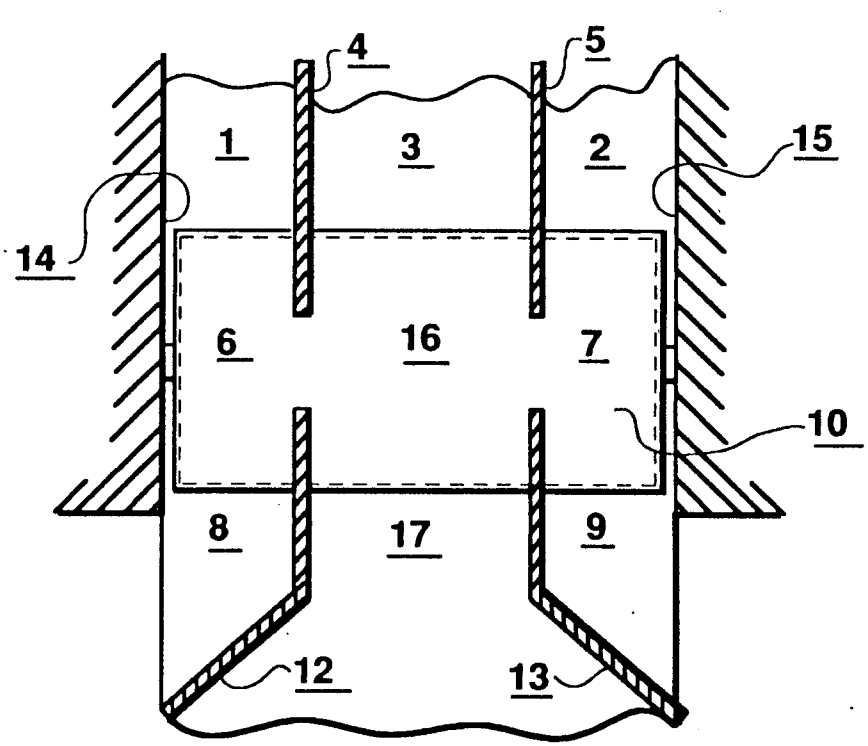
FIG. 2 is a lengthwise, substantially horizontal, view of the roll crusher depicted in FIG. 1 along axis A—A.
Figure 1:
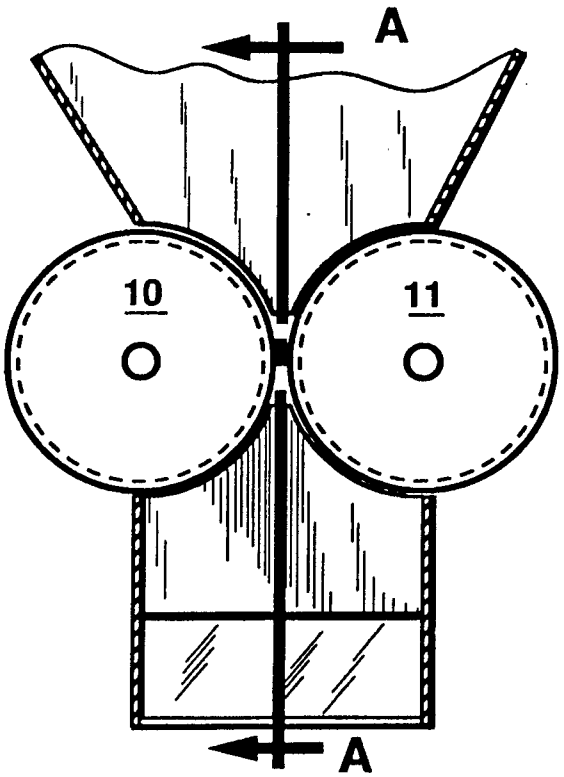
FIG. 1 illustrates a side view of two parallel cylindrical rollers 10 and 11 utilized in the present invention.

Referring more specifically to FIG. 2, there is illustrated a lengthwise view of roller 10 which is one roller of a two roller crusher with the second roller 11 parallel to roller 10. The view of the drawing is from the gap between the two rollers and therefore roller 11 is not depicted in the drawing. Roller 10 has end plates 14 and 15 and is, via partitions 4 and 5, divided into three distinct feed inlet zones, depicted as initial feed inlet zones 1 and 2 and secondary feed inlet zone 3. In the practice of the present invention basically equivalent amounts of appropriate fresh brittle material are fed downwardly from a feed hopper (not shown) to initial feed inlet zones 1 and 2. The material then passes between the rollers into initial crushing zones 6 and 7 which extend the same distance across the length of the roller as the feed inlet zone with which they are in communication. The material then exits the roll crusher via exit areas 8 and 9, which are defined by partitions 12 and 13. The thus comminuted material is then recirculated, without the significant breakup of any agglomerates, into secondary inlet zone 3, whereupon it passes into the secondary crushing zone 16, and exits the crusher via secondary exit area 17.

The determination of the total area in which the comminution process can take place in the initial crushing zone(s), as measured across the length of the roller face, will generally be approximately equal to the area provided for crushing in the secondary crushing zone(s), although this is not a crucial feature of the present invention and may vary according to the needs of the individual practitioner of the invention. The exact area will depend on parameters such as the type of material being processed, the desired capacity of the roll crusher, etc. The ultimate determination of the area for each of the feed inlet zones and feed crushing zones in any given application will be based, in part, on testing of the specific raw material to be comminuted and, as indicated, such determination will be well within the ability of a practitioner having ordinary skills in the art. While not required to obtain the desired operation, ideally there will be a continuous operation of the roll crusher of the present invention to obtain maximum power savings. The area of the feed inlet zones will be chosen so as to prevent there being an excessive build up of feed in either the initial feed zones or the secondary feed zone. However, depending upon the needs of the individual practitioner of this invention, it is understood that for capacity control purposes some of the product exiting the initial crushing zone(s) can be recirculated through the initial feed inlet zone prior to being introduced into the secondary feed inlet zone; likewise, some of the product exiting the secondary crushing zone may be recirculated back through either the initial or secondary feed inlet zones. In any event, it is essential to the practice of the present invention that the final product from the roll crusher of the present invention come only from the secondary crushing zone and that any fresh feed be introduced into the crusher only via the initial feed inlet zones. Depending upon the material being processed, the preferred length of the roller face utilized for the initial inlet zone(s) preferably ranges from 25% to 400% of the length, and the preferred ratio of the length of the roller face utilized for the initial crushing zone(s) to the length of the roll face utilized for the secondary crushing zone will be comparable to the percent ranges set forth above. Thus, in the preferred practice of this invention, each of the two initial feed inlet zones may extend from each of the ends of the roll across up to a maximum of about 40% of the length of the roll face.

As indicated, the material to be processed is comminuted and stressed in the feed crushing zones at a pressure sufficient to have at least some of said material form into agglomerates. The material that is to be restressed is fed, in a second pass, at a pressure sufficient to form agglomerates on said second pass, between the parallel rollers in a secondary feed zone. Preferably, there will be only one secondary feed zone and it will extend from the center point of the roller in both directions across the width of said roll across at least 10% of the total width of said roll. As indicated, it is preferred that said secondary feed zone does not extend to either edge of said grinding rollers.

Preferably, the roll crusher utilized in the invention will consist of two parallel, cylindrical rollers operated in a counter rotating fashion with the axis of said rollers preferably being horizontally located relative to each other.

Typically, the surfaces of the rollers of the roller crusher can be smooth, but in order to improve the entering conditions in the roller gap, projecting profiles such as welding beads can be applied to the smooth roller surface under some conditions. The resulting pressed slabs are thereby simultaneously provided with inherent break points. The rollers may include end plates.

The partitions utilized to form the specific feed inlet zones employed in the practice of this invention can be fashioned out of any suitable material that will withstand wear associated with the specific operating conditions utilized in the process. Preferably, the partitions should be adjustable to enable the practitioner of the invention to change the relative areas of the initial and secondary feed inlets and, therefore, the initial and secondary crushing zones according to the demands of any specific application.

The following examples were run using a Allis-Chalmers roll crusher that had parallel rollers 18" in diameter that were 6 inches in width for single pass tests which are comparable to the process as described in U.S. Pat. No. 4,357,287 and were expanded to 8 inches in length, with partitions added to define the specific initial and secondary feed inlet zones, for the multi-pass tests of the present invention. The roll crusher also contained suitable recirculation equipment for the multi-pass tests which are exemplary of the process of the present invention. In the apparatus utilized for said tests, there were two initial inlet zones both of which started at each end of the rolls and extended approximately 2 inches across the length of the rolls. There was one secondary feed inlet zone which was located over the middle 4 inches of the rolls. Thus, in terms of the distance across the length of the rollers, the roller area of the two initial feed inlet zones were approximately equal to the area of the secondary feed inlet zone. The 3 feed crushing zones, i.e., the two initial feed crushing zones and the secondary feed crushing zone, were equal in size to their respective feed inlet zones, as measured across the length of the roller. The material exiting from each of the initial feed crushing zones was collected, combined and recirculated through the secondary inlet zone without there being any substantial breakup of any of the agglomerates formed in said first feed crushing zone. The total energy expended after the second pass was calculated and was compared to the total energy expended by crushing in a single pass.

Table 1 sets forth the data from "single pass" tests and "multi pass" tests run on raw material typically utilized in a cement making process which, in this instance, was primarily comprised of limestone. The data set forth in Table 2 also relates single pass and multi pass tests which were run on a cement clinker. By "single pass" it is meant that the material is commincated in a conventional roll crusher which does not have any specific inlet zones. The material is collected and any agglomerates formed during the pass are disintegrated. The purpose of these tests was, among other things, to determine if the multi-pass method of the present invention resulted in energy savings when compared to a process wherein the material to be comminuted is stressed only once, such as taught by U.S. Pat. No. 4,357,287. As indicated above in the single pass test, the indicated material was fed through a roll crusher that was not modified according to the invention to have the specific separate initial and secondary feed inlet and crusher zones. The material was stressed at a pressure from about 900–2000 psi, which in every instance was sufficient to cause the formation of agglomerates. The material was collected, the agglomerates formed were disintegrated, and the resulting product was tested to provide the data set forth in Tables 1 and 2.

In the tables, the term P80 refers to the screen size through which eighty percent of the material passes. The terms "feed power" and final product power are calculated figures for the amount of power a ball mill would require to reduce, respectively, the raw mix feed and the final product, to a size whereby 80% of the said feed or final product would pass through a 200 mesh screen. The term "roll crusher power" refers to the actual measured amount of power utilized by the roll crusher to perform the designated crushing action, whether it be in only one pass as per the prior art method or a double pass as per the present invention. The terms "feed power" and "roll crusher power" have the same meaning for clinker feed and/or product, except the figures refer to achieving a final product of which 80 percent of which has a size of 3500 blaine.

The results of the tests as set forth in Table 1 and Table 2 indicate that, on the average, there were additional power savings of between about 5 and 8 percent realized by stressing the material a second time when compared to the prior art single stressing.

TABLE 1

| | RAW MATERIAL | |
|---|---|---|
| Summary | Multiple Pass Results | Single Pass Results |
| Roll crusher power pass, kWh/st | 4.27 | 2.43 |

TABLE 1-continued

| Summary | RAW MATERIAL Multiple Pass Results | Single Pass Results |
|---|---|---|
| Final product power, kWh/st | 9.70 | 12.34 |
| Total Power Required | 13.97 kWh/st | 14.77 kWh/st |
| % of feed power | 85.4% | 90.3% |
| P80 | 2.03 | 2.88 |

TABLE 2

| | CLINKER Multiple Pass Results | Single Pass Results |
|---|---|---|
| Roll crusher power | 9.64 | 4.61 |
| Final product power | 18.08 | 25.88 |
| Total power required | 27.72 | 30.49 |
| Percent of feed power | 81.1% | 89.2% |
| P80 | 1.05 | 1.34 |

It will be evident that various modifications can be made to the described embodiments without departing from the scope of the present invention.

What is claimed is:

1. A method for the comminution of brittle material in a roll crusher which comprises the steps of (a) introducing fresh feed material into a roll crusher, which roll crusher is divided into two distinct feed inlet zones which are at least one initial feed inlet zone for said fresh feed material and at least one secondary feed inlet zone for feed which has been stressed at least once by said roll crusher; wherein each initial feed inlet zone and each secondary feed inlet zone directs feed into, respectively, a distinct corresponding initial feed crushing zone and a distinct secondary feed crushing zone, wherein said fresh feed material is introduced into said roll crusher only in said at least one initial feed inlet zone whereby it is stressed at pressures sufficient to cause the formation of at least some agglomerates in said material; and (b) recirculating product formed by step (a), without causing any substantial disintegration of the agglomerates, into the roll crusher through said at least one secondary feed inlet zone so that it is further stressed at pressures sufficient to cause the formation of at least some agglomerates in said material; with the proviso that product from said initial feed crushing zone will always be recirculted through the roll crusher.

2. The method according to claim 1 wherein the agglomerates formed in the material as a result of steps (a) and (b) are disintegrated after the material finally exits the roll crusher.

3. The method according to claim 2 wherein the material, following said disintegration step, is subject to classification.

4. The method according to claim 2 wherein said disintegration is carried out in a ball mill.

5. The method according to claim 2 wherein said step of disintegration is carried out in an impact mill.

6. The method of claim 1 wherein product formed by step (a) is recirculated back through the roll crusher through said at least one initial feed inlet zone prior to being recirculated to said at least one secondary feed inlet zone.

7. The method of claim 1 wherein product formed by step (b) is recirculated back through the roll crusher.

8. The method according to claim 1 wherein the brittle material is utilized for cement production and selected from the group consisting of cement clinker, ores, coals, lime, bauxite, dolomite and alkaline earth carbonates and mixtures thereof.

9. The method of claim 1 including providing a roll crusher consisting of a pair of rolls, the axis of each roll being located substantially parallel and horizontal to each other.

10. The method of claim 9 including providing two separate initial feed inlet zones and one secondary feed inlet zone.

11. The method of claim 10 wherein each of the initial feed inlet zones are separately located at each of the edges of the rolls and each initial feed inlet zone separately extends from each edge across the length of said rolls up to 40% of the total length of said rolls.

12. The method of claim 1 which is a continuous process.

13. A roll crusher for the comminution of brittle material which comprises:

(a) two distinct feed inlet zones which are at least one initial feed inlet zone for fresh feed material and at least one secondary feed inlet zone for feed which has been stressed at least once by said roll crusher, wherein each initial feed inlet zone and each secondary feed inlet zone directs feed into, respectively, a distinct corresponding initial feed crushing zone and a distinct secondary feed crushing zone, wherein each of said inlet zones is capable of stressing the material at pressures sufficient to cause the formation of at least some agglomerates in said material; and (b) recirculating means for recirculating the product stressed in said initial feed crushing zone, without causing any substantial disintegration of the agglomerates therein, into the roll crusher through said secondary feed inlet zone whereby it is further stressed at pressures sufficient to cause the formation of at least some agglomerates in said material.

14. The roll crusher of claim 13 which comprises a pair of rolls, the axis of each roll being located substantially parallel and horizontal to each other.

15. The roll crusher of claim 14 wherein there are two separate initial feed inlet zones and one secondary feed inlet zone.

16. The roll crusher of claim 15 wherein each of the initial feed inlet zones are separately located at each of the edges of the rolls and each initial feed inlet zone separately extends from each edge across the width of said rolls up to 40% of the total width of said rolls.

* * * * *